United States Patent [19]

Hindle

[11] Patent Number: 4,747,797

[45] Date of Patent: May 31, 1988

[54] MAN OVERBOARD RETRIEVAL APPARATUS

[76] Inventor: John D. Hindle, 57 Beech Grove, Guilford, Surrey, England

[21] Appl. No.: 912,336

[22] PCT Filed: Jan. 20, 1986

[86] PCT No.: PCT/GB86/00036

§ 371 Date: Oct. 8, 1986

§ 102(e) Date: Oct. 8, 1986

[87] PCT Pub. No.: WO86/04312

PCT Pub. Date: Jul. 31, 1986

[30] Foreign Application Priority Data

Jan. 22, 1985 [GB] United Kingdom ..... 8501540
Dec. 23, 1985 [GB] United Kingdom ..... 8531577

[51] Int. Cl.[4] ..... B63C 9/04

[52] U.S. Cl. ..... 441/38; 441/39; 441/40; 114/349; 114/311; 114/138

[58] Field of Search ..... 441/80, 83, 84, 86, 441/40, 43, 35, 36, 37, 38, 87; 114/348, 349, 40, 43, 130, 140, 131, 138, 311; 182/142; 5/89; 244/137 P, 141

[56] References Cited

U.S. PATENT DOCUMENTS 4,533,333 8/1985 Andrew et al. ..... 441/38

FOREIGN PATENT DOCUMENTS 92006 1/1962 Denmark ..... 441/38
1059424 2/1967 United Kingdom ..... 441/40
244900 5/1969 U.S.S.R. ..... 114/311

*Primary Examiner*—Joseph F. Peters, Jr.
*Assistant Examiner*—Edwin L. Swinehart
*Attorney, Agent, or Firm*—Mattern, Ware, Stoltz & Fressola

[57] ABSTRACT

A life buoy 1 in the form of an inflatable ring with a floor 10 has a textile, invert cone keel 11 filled with water and held open by a ballast mass 14. Around the keel hangs an open mesh textile sea anchor 25. Steps 18, braced 20 to the keel, assist a man overboard in entering the life buoy. The life buoy is detachably provided with a sling 30, having a lifting eye 31 for lifting the man overboard from the life buoy.

18 Claims, 7 Drawing Sheets

FIG. 1.
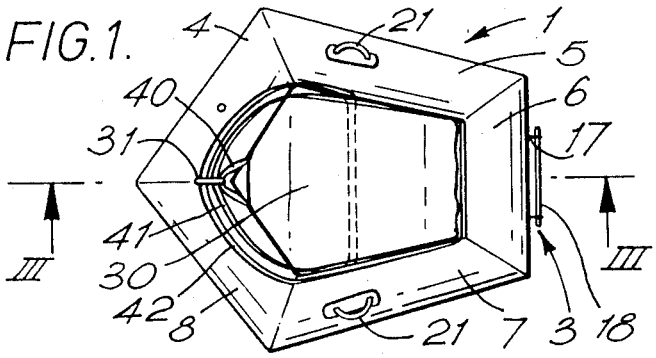
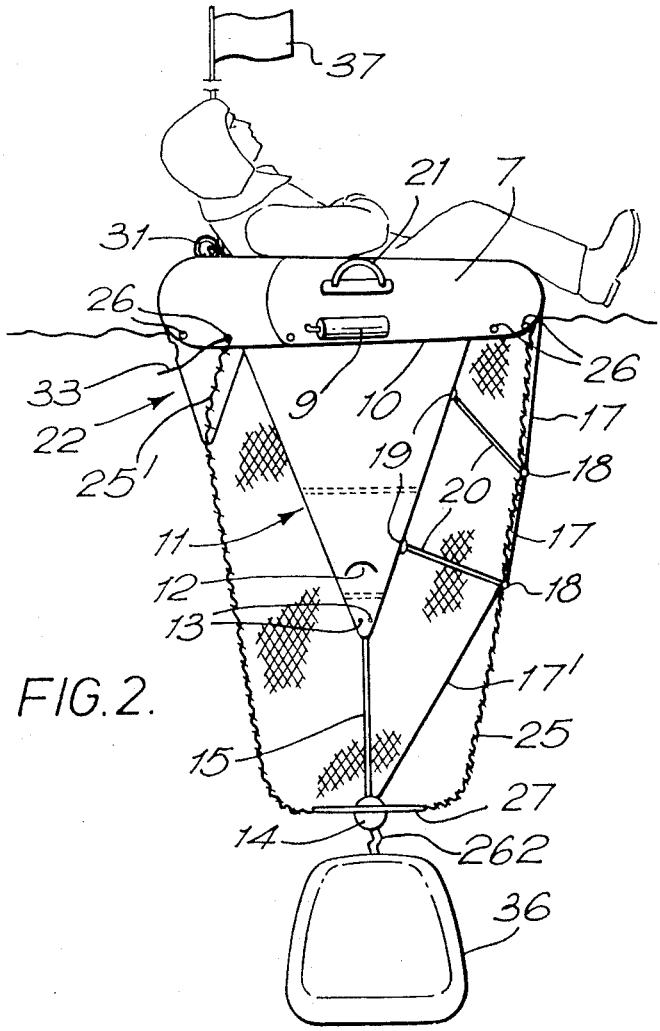
FIG. 2.

MAN OVERBOARD RETRIEVAL APPARATUS

The present invention relates to man overboard retrieval apparatus.

BACKGROUND OF THE INVENTION

Retrieval of a man overboard from a yacht or other vessel is a severe problem. Various apparatuses exist for assisting in the problem from the conventional circular or horseshoe shaped life buoy to nets and lifting slings for assisting the man back aboard.

There are three specific areas of difficulty in the problem:

Firstly, a man overboard requires support whilst in the water. The colder the water—the severer the weather—and the more difficulty the man has in swimming, the more support the man requires, and the quicker he requires it.

Secondly, sight of a man overboard from a yacht is remarkably easily lost; accordingly the search for the man may take longer than it should and can too easily fail altogether.

Thirdly, once a yacht is alongside a man overboard, lifting him aboard the yacht can require use of a halyard or topping lift, especially in adverse conditions where the man is weakened to the extent that he cannot help himself.

The object of the present invention is to provide man overboard retrieval apparatus which in one apparatus addresses these three problem areas at least.

THE INVENTION

The man overboard retrieval apparatus of the invention comprises:

- an inflatable life buoy with a configuration having an upper part which is downwardly concave—when floating in a use position—and is of a size to at least partially accommodate the torso of a man; and
- a sling for lifting the man arranged at the upper part of the life buoy, the sling having one or more man supporting members and a lifting eye to which the supporting member(s) are secured;
- the eye being so carried by the life buoy as to be easily detached therefrom for lifting of the man with the supporting member(s) extending down from the eye to liftingly support the man.

The apparatus of the invention alleviates the problem areas:

- firstly by holding up the man once he has boarded the buoy;
- secondly by being considerably more prominent than the man due to its greater size; and
- thirdly by providing the means for lifting the man back aboard the yacht or other vessel.

The configuration is conveniently given by an inflatable tubular ring with a floor. Preferably it is longer than it is wide to fit a man's torso. Irregular pentagonal shape is convenient, especially with the tube sections at one end apex being of larger diameter than that at the opposite end.

In the preferred embodiment, the sling is detachable from the life buoy on lifting. To provide automatic disposition of the supporting members below the man once he has boarded the life buoy, they are preferably arranged to extend laterally across the upper part of the life buoy. Conveniently three supporting members are provided, one positioned to be drawn up across the man's back at his shoulder blades, the second at his back side and the third behind his knees. Preferably the supporting members are secured in the life buoy by detachably fastening means such as hook and loop fastening strips sold under the Registered trade mark VELCRO. Such arrangement requires no conscious effort on the part of the man to arrange the support members about him nor any buckling of the supporting members.

Preferably the supporting members will be interconnected by woven textile material. Indeed the entire sling—other than the eye—could be of such material.

It is enivsaged that the sling might not be detachable from the buoy but be an integral part of it, but this is not preferred.

Another problem area is that of the man overboard reaching the apparatus. In a high wind, a life buoy can be blown away faster than the man can swim. Accordingly the apparatus is preferably fitted with a ballasted keel which also serves to prevent the life buoy being blown upside down by the wind.

The preferred keel is an invert cone attached to the floor, or tubular ring, and provided with ballast at or below the apex. Where such a cone is of woven fabric, it can be made semi-rigid by providing that it has water ingress apertures adjacent its tip only. Thus it fills with water to the virtual exclusion of air on deployment. To facilitate filling the apertures may be large and provided with non-return valves.

Other rigid, telescopic keels are envisaged.

The keel is preferably augmeted in preventing wind drift by the provision of a sea anchor. Whilst a conventional drogue could be used, its line would be liable to foul propellers. Accordingly the preferred sea anchor is a curtain of textile material hung down from the inflatable ring to the level of the ballast.

Yet another problem area can be the ability of a man overboard to help himself—due to cold etc. The apparatus of the invention requires the man's effort only in first reaching it and then boarding it. To assist in the latter, the life buoy is provided with steps. An ordinary rope ladder has a tendency for its rungs to swing away from the user. To obviate this, at least some of the rungs of the ladder are preferably provided with rigid brace(s) to the keel to hold the ladder spaced from the keel. Opposite from the ladder, the life buoy is preferably provided with a water pocket which tends to be lifted from the water on climbing of the ladder by the man.

THE DRAWINGS

To help understanding of my invention, three specific embodiments thereof will now be described by way of example and with reference to the accompanying drawings, in which:

FIG. 1 is a plan view of a first man overboard retrieval apparatus of the invention inflated for use;

FIG. 2 is a side view of the apparatus of FIG. 1 in use;

Figure 3:
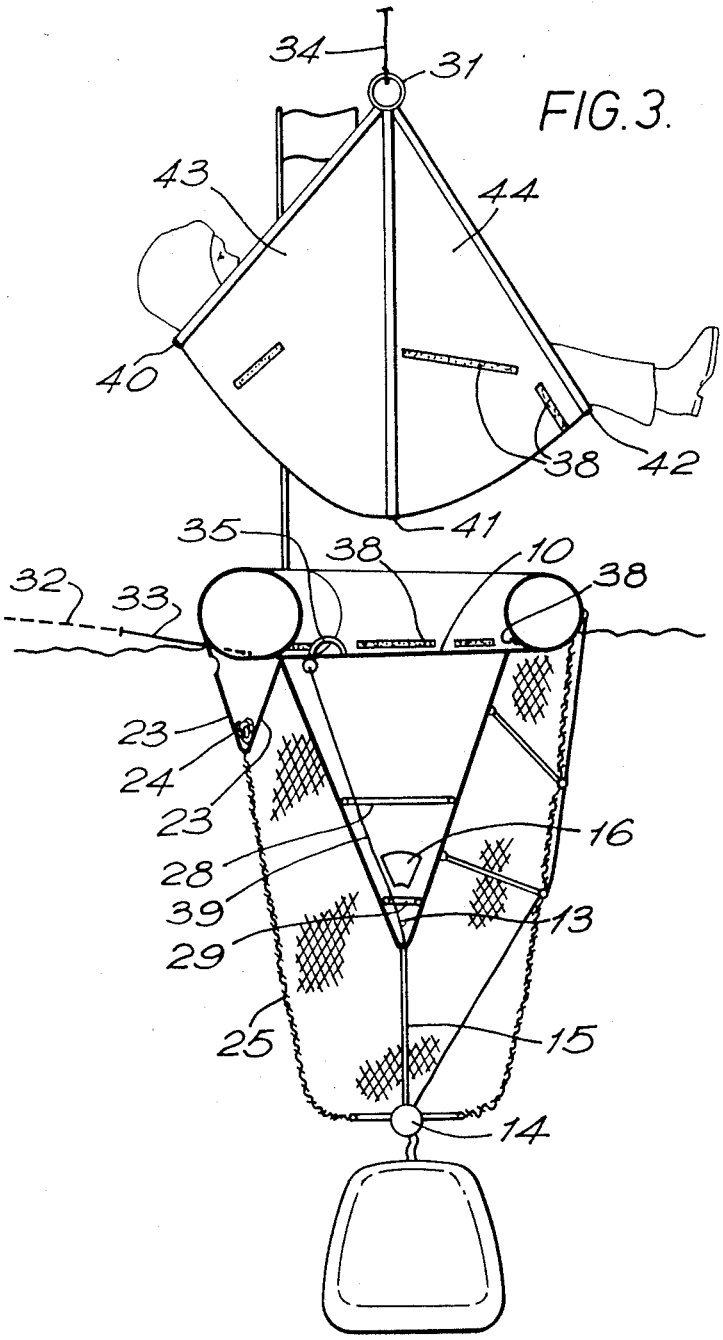
FIG. 3 is a cross-side view on line III—III in FIG. 1, similar to FIG. 2 but showing a man being lifted from the apparatus.
Figure 6:
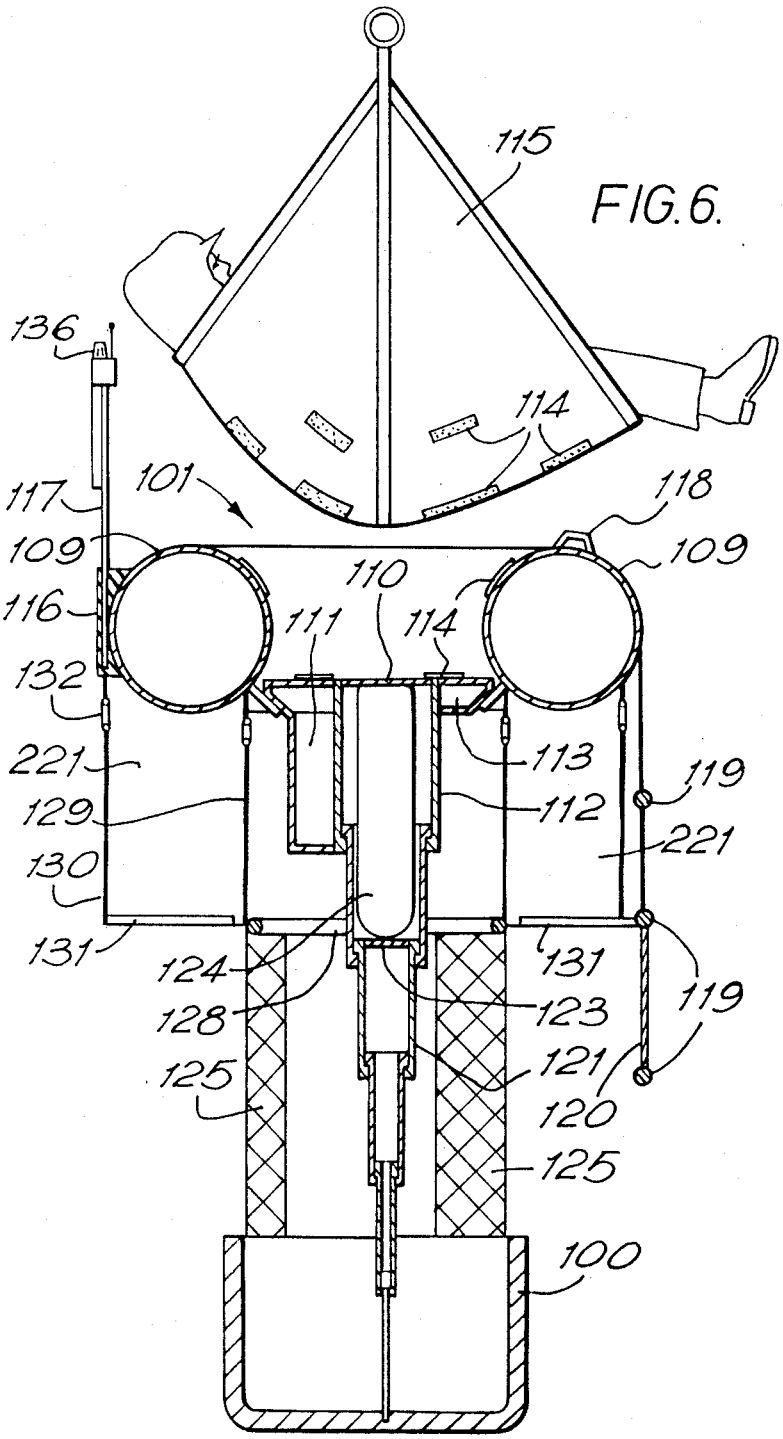
Figure 7:
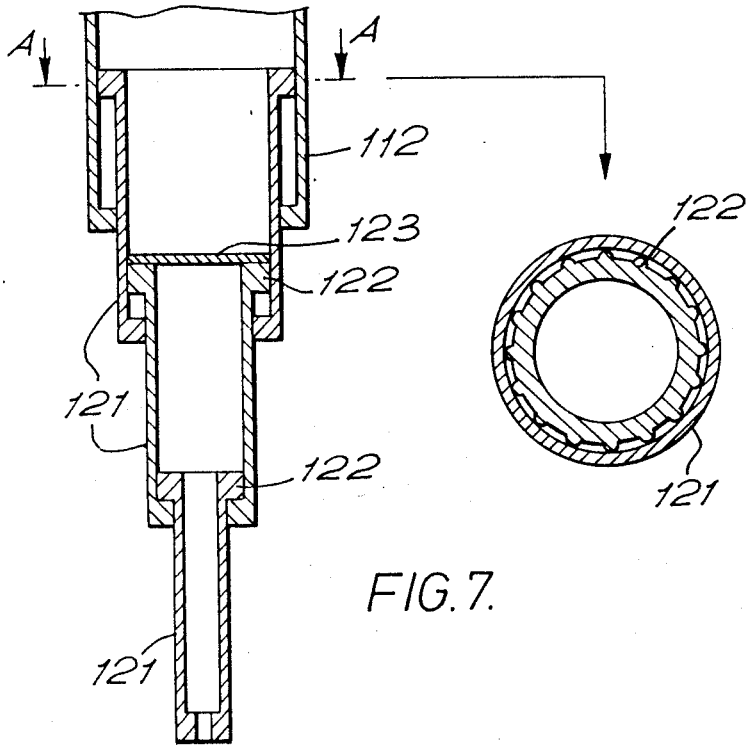
Figure 8:
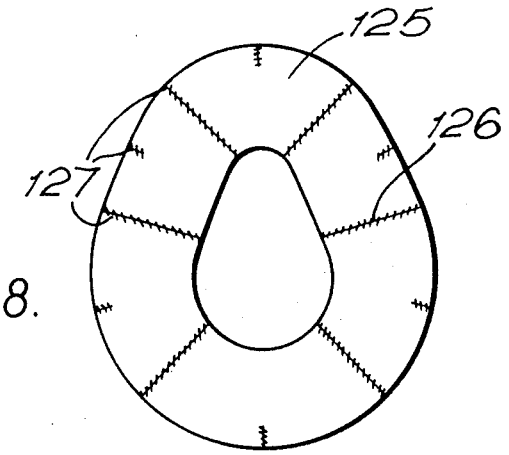
Figure 9:
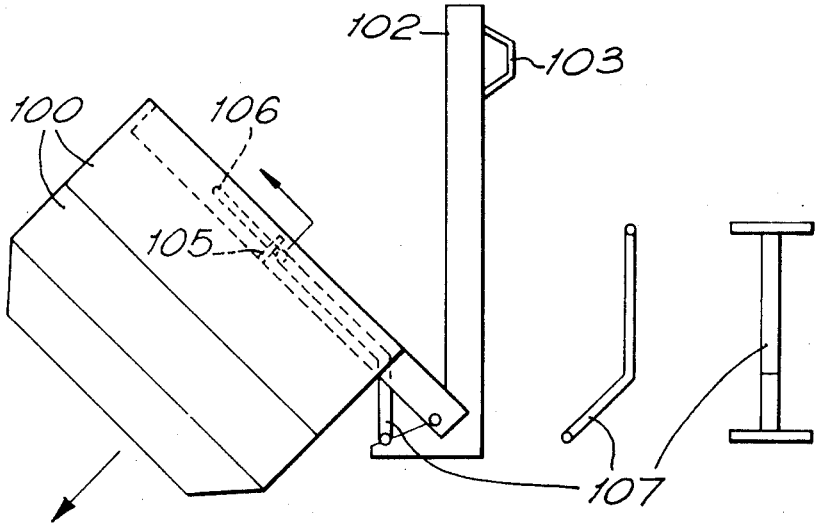
Figure 10:
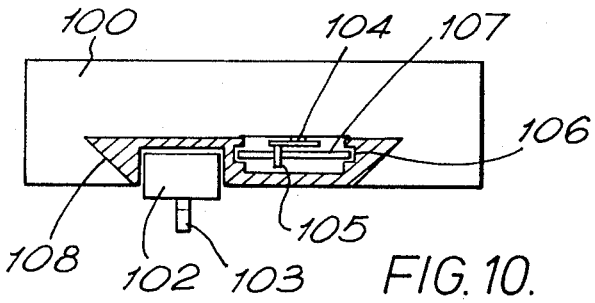
Figure 11:
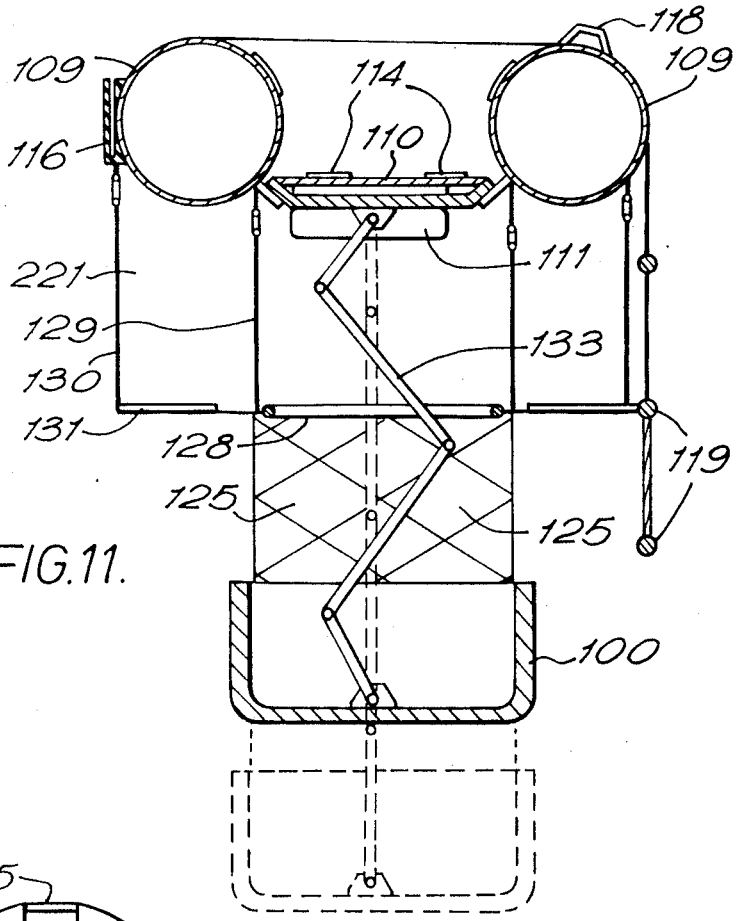
Figure 12:
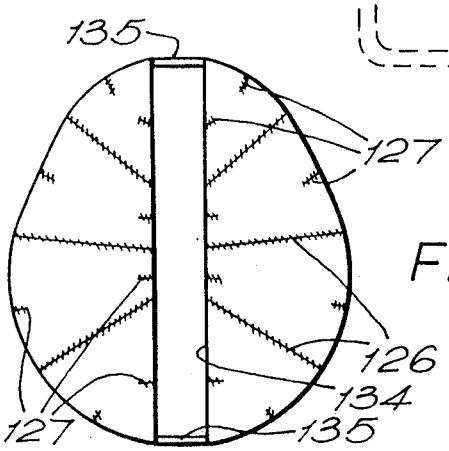

FIG. 6 a view similar to FIG. 3 of a second man overboard retrieval apparatus of the invention;

FIG. 7 is two cross-sectional detail views of the telescopic leg of the apparatus of FIG. 6;

FIG. 8 is a detail plan view of a cloth sea anchor detached from the life buoy of FIG. 6;

FIG. 9 is a side view of a launching mechanism for the apparatus of FIG. 6;

FIG. 10 is a cross-sectional plan view of the launching mechanism of FIG. 9;

FIG. 11 is a view similar to FIG. 6 of a third apparatus of the invention with its sling removed; and FIG. 12 is a view similar to FIG. 8 of the cloth sea anchor for the apparatus of FIG. 11.

THE FIRST EMBODIMENT

The apparatus of FIGS. 1 to 3 comprises a miniature life raft or life buoy 1 having an irregular pentagon shape defining a "bow" 2 and a "transom" 3. The buoy is given its shape by a polyether-coated, nylon woven textile inflatable tube of circular cross-section when inflated and comprised of five generally straight sections 4,5,6,7,8 angularly joined together. In the simplest arrangement, the tube is arranged as a single compartment inflated from a pressurized gas bottle 9 on launch of the buoy. A pressure relief valve—not shown—is provided. In use, it is over the transom section 6 where a man overboard climbs, whilst the bow sections 4,8 assist in supporting him semi-upright once aboard. Accordingly the transom section 6 has a smaller diameter whilst the bow sections 4,8 have a larger diameter. The intervening sections 5,7 taper between the larger and smaller diameters.

Connecting between the lowermost (in the normal floating position) portions of the sections is a floor 10 of the same material as the tube. Below the floor is a connected invert cone 11 of similar, though lightly coated fabric, which forms a keel. It is provided with water ingress apertures 12 at its tip and is otherwise closed, in particular at its widest, upper part by being connected to the floor by welding, except that three small breather holes 13 are provided at the tip for drainage of water from the cone on retrieval of the buoy. Below the tip hangs a mass 14 having a fixed length or telescopic rigid rod 15 interconnecting the cone tip and the mass. The rod is rigid to ensure that on launch the mass remains outside the buoy and ultimately falls to its suspended position.

The purpose of the mass is to extend the cone on launch. This causes the water to enter the cone through the apertures 12. These have inside, non-return valve, flaps 16 which act to prevent water egress as might otherwise occur if wind or waves were to lift the buoy above its normally floating height. The arrangement thus operates as a semi-rigid keel. (Water egress through the breather holes 13 is minimal during the buoy's movement in riding waves.)

To assist a man overboard in climbing onto the life buoy it is provided with a ladder hanging from the transon section 6. The vertical parts 17 of the ladder are of rope. The two rungs 18 are rigid. A pair of lines 17' connect the lower rung to the mass 14 to ensure that the rungs are pulled down on launch. To brace the rungs against being swung away from a man trying to climb them, their mid points are rigidly connected to points 19 on the cone by rods 20. Handles 21 are provided on the sections 5,7.

The man's weight on the ladder will tend to lift the bow 2. To counteract this a water pocket 22 which is triangular in cross-section is secured to the underside of the floor at the bow. It has water ingress apertures towards the top of its sidewalls 23, fore and aft ones of which are closed together laterally of the buoy. Chain ballast 24 causes the pocket 22 to deploy for filling with water. When the man climbs the ladder, water in the pocket is lifted above the ambient water level and its weight tends to counterbalance the weight of the man.

The buoy is provided with a drogue or sea anchor skirt 25 of open knitted nylon material. The skirt is in the form of a tube shackled to points 26 around the buoy and hanging down therefrom. The bottom of the skirt is gathered to a lightly weighted ring 27. A downwards extending opening in the skirt is provided at the steps 18 and the edges of the opening are attached to the ropes 17, whereby the skirt does not impede the ladder. The purpos of the drogue skirt is to assist the keel in preventing the buoy from being blown away from the man overboard before he can board it. The drogue skirt has a small cut out 25' at the bow to clear the water pocket 22 and the rope 33 (described below).

As described the cone is circular in horizontal cross-section and supported in this shape by upper and lower rigid rings 28,29 secured inside the cone. Other configurations are envisaged to be possible.

The buoy is provided with a detachable sling 30 having a lifting eye 31 from which extend three webbing supports 0,41,42 to pass across the man's back at his shoulder blades, under his back side and behind his knees during lifting as shown in FIG. 3. Between the webbing supports woven textile panels 43,44 are provided. VELCRO (Registered trade mark) fastening strips 38, which normally retain the sling in position in the buoy, are provided on the sling and on the inflatable tube in positions shown in FIG. 3.

Figure 4:
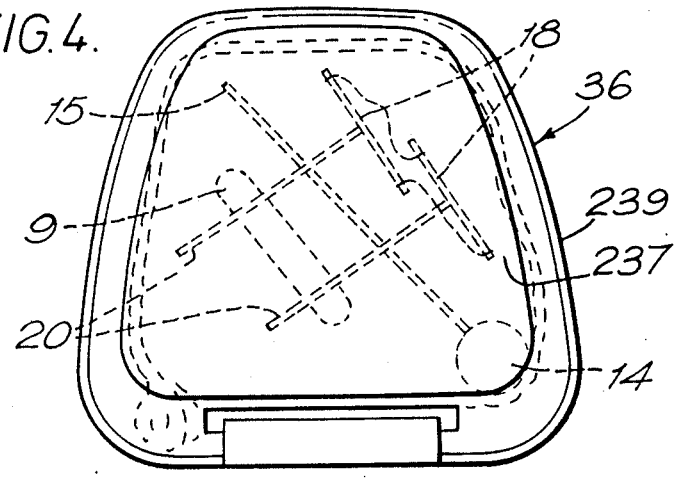
FIG. 4 is a side view of a stowage cover for the apparatus of FIG. 1, showing in outline components of the life buoy packed inside it.
Figure 5:
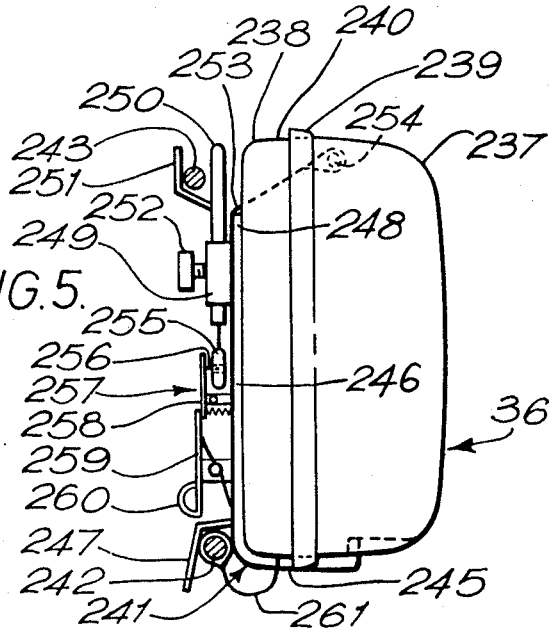
FIG. 5 is an end view of the cover.

In use, the life buoy 1 is launched from a rigid cover 6. This is shown in FIGS. 4 and 5 and has two moulded plastics material parts 237,238. The outer one 237 of these has a stepped lip 239 which accommodates the lip 240 of the other 238. A stainless steel bracket 241 supports the cover prior to use of the apparatus on a yacht's "pushpit" rails 242,243. The bracket 241 has a generally L-shaped plate, the foot 245 of which carries the weight of the cover and engages the lip 239 at its lowest portion. The upright portion 246 of the plate carries a downwardly open hook 247 which engages over the lower rail 242. Towards its top edge 248, the portion 246 carries two welded-on, upright tubes 249 in which are accommodated the arms of an invert U rod 250. The U rod carries an upwardly open hook 251 which engages under the upper rail 243. The hooks 247,251 are held apart for gripping the rails 242,243 by screw knobs 252 threadedly engaging the arms of the U rod 250 through the tubes 249.

The cover 36 is held back against the upright portion 246 of the L plate 244 by a strap 253 passing through a slot in the inner cover part 238 and secured to a bar 254 provided inside the outer cover part 237. The strap 253 has a buckle fitting 255 in which a tongue 256 of a release catch 257 engages. The tongue 257 projects in from a centrally pivoted catch lever 258, a spring biassing the tongue to remain engaged. For launch of the life buoy, the tongue 257 is withdrawn by a second lever 259 bearing on the end of the lever 258 opposite from the tongue. The second lever is also spring biassed and centrally pivoted. It has a release pull ring 260 secured to its end opposite from the lever 258. Thus pulling of the ring 260 away from the cover 36 moves the tongue 257 away and releases the buckle fitting 255.

A gas release cord 261 passes out of an opening in the inner cover part 238 and is secured to the lower rail 242.

On launch of the apparatus, the entire cover 36 falls away from the bracket 241 and hence its weight on the cord 261 withdraws a release pin (not shown) from the gas bottle 9. The cover is opened by initial expansion of gas into the tube 4,5,6,7,8. The packing of the buoy into the cover 36 is such that the mass 14 falls free at an early stage and causes the invert cone keel 11 to deploy. The parts 237,238 of the cover remain attached together and come to hang via a line 262 below the mass 14. The keel 11 is packed with negligible air within it and consequently fills substantially entirely with water. Thus the steps 18 are deployed below the "stern" tube 6.

The man overboard swims to the buoy and clambers aboard it, lies with his feet over the "stern" tube 6 and his head and shoulders supported on the "bow" tubes 4,8. The sling 30 extends beneath him. For visibility the buoy has a self-erecting mast and flag 37.

Once the man is on the buoy it continues to drift only slowly due to the action of the drogue skirt and in due course the vessel returns. It attaches a line 32 to a rope 33 hanging between two points 26 at the bows and a further line 34 to the sling's lifting eye 31. The latter is detachably mounted on the tube section 4 and on hoisting on the line 34, the sling is pulled around the man who can be thus swung aboard the vessel.

When he is thus safely rescued, the line 34 is connected to a ring 35 on the floor 10 for lifting of the buoy from the water. Although the relatively small water pocket 22 remains full, the larger cone 11 drains slowly from the breather holes 13. To relieve the cone of the weight of the mass 14 on lifting, a line 39 is provided between the eye 35 and the upper end of the rod 15.

SECOND EMBODIMENT

Referring to FIGS. 6 to 10, the life buoy 101 is manufactured from a strong, waterproof and airtight fabric. The basic shape is of a tubular inflated ring formed into an overall egg shape, one end being narrower than the other. The actual size of the buoy is determined by the minimum size required to support the intrinsic weight, plus a man in wet clothing, but could be larger for use, say, on ships. For safety the inflatable is divided into three or more buoyancy tanks 109, see FIG. 7, each with their own non-return air valves. The floor 110 of the buoy is a rigid section of the same shape as the inflatable ring 101. Incorporated in this floor is a chamber for the gas canister 111 and the first section of a rigid sea anchor leg 112. Also incorporated is a hollow floor section 113 that houses the inflation tubes from the gas canister to each of the inflatable sections. VELCRO tape 114 is attached to several places inside the buoy, these correspond to tape attached to the survival bag 115 described later. At the narrower or bow end of the buoy (the head end) is attached on the outside a rubber type housing 116 into which the audio-visual aid pole 117 is firmly inserted. At the wider part (the feet end) are attached handles 118 which aid a man to climb into the buoy using the steps 119 that are incorporated in the water pockets 221 described later. All around the buoy are hand holds.

The inflatable ring folds onto and around the rigid floor, and is inflated automatically when the rip-cord attached to the gas canister is pulled.

For use, the buoy is packed into a rigid casing 100 divided into two parts, see FIG. 9. The inner part is attached securely to a vertical bracket hinged at the base which in turn is attached securely to the side of the boat (the most effective position is likely to be over the transom). The hinged bracket is spring loaded and is kept vertical by a fixed pole 102, see FIGS. 9 and 10. The fixed pole incorporates a handle release mechanism 103 and use of this will result in the launching of the buoy. The outer casing is held in place by two catches, one at either side and these are activated by turning a handle 104. This handle is automatically turned by a sliding arm as the bracket falls away from the vertical position. The handle has an extension bar 105 protruding from one side of it. There are two opposite grooves in the moving bracket 106 into which is fitted a sliding cross-bar which is integral to an arm, bent in the middle to avoid fouling the casing, and which is hinged at the bottom 107. The hinge on this arm is sited in front of the main bracket hinge so that when the bracket moves downwards the cross-bar is pushed up the groove and comes into contact with the extension bar 105 on the handle; the handle is turned by this action.

By the time the bracket and casing is approaching the horizontal position the two catches have fully opened and the outer casing, being ballasted, falls away into the water taking with it the inflatable buoy. The rip-cord for activating the gas canister(s), which in turn inflate the buoy, is attached to the inner casing which stays with the boat and is therefore pulled as the buoy falls away. The inner casing can be removed from the bracket whilst in an upright position by releasing a catch and lifting it off. The bracket and casing have an interlocking wedge shape to hold them together.

The life buoy 101 has a four section keel/sea anchor structure: a rigid inner spine or telescopic leg, ballast, a cloth sea anchor that is designed to offer the maximum resistance in water when in the 'open' position, and a series of water pockets that hang beneath the inflatable buoy. The pockets incorporate steps on one side to aid a person climbing into the buoy.

The purpose of the water pockets is to keep the buoy sitting in the water. As wave action exposes one side of the buoy the wind cannot easily get underneath and lift it out because the outer skirt acts as a wall. Also as it is lifted, the water in the pockets is raised above sea level at that point and, water being heavier than air, it is pulled back downwards keeping the buoy stable and firmly in the water.

The telescopic leg is made up of several tubes of equal length that slide and fit into one another. The top tube 112 is rigidly attached, or indeed can be integral to, the floor 110. The other tubes 121, each diminishing in diameter form the telescopic leg. The bottom tube is rigidly attached to the ballasted casing 100. To reduce friction each tube is in fact a loose fit within the other but lips 122, integral to each tube, one at the top on the outside and one at the bottom in the inside, form a sliding fit between each successive tube and also act as a stop when each tube is fully extended. To reduce friction even further each lip is grooved longitudinally around its sliding face, see FIG. 2, cross-section A—A. The third tube down is blanked-off at the top 123. An inflatable 'piston' 124 is inflated along with the buoyancy tanks and forces down the first three sections of the telescopic leg by pushing against the plate 123 on top of tube number 103. With the extension of the first three tubes, the ballast is also extended and the buoy is therefore self righting and will always float the correct way up. The tube 112 is longer than the other tubes in that it enters into the floor 110 box section to allow enough room at the top for the inflatable piston 124 to be stowed when the telescopic arms are in the closed position.

Ballast is actually integral to the outer casing 101 into which at least half of the buoy is encased when stowed. The bottom leg of the telescopic arm is securely attached to the inside of the casing. The casing is made of non corrosive material and has fixing points around the inside for attaching a cloth sea anchor.

The cloth sea anchor 125 is made up of several sheets of suitable cloth (waxed canvas, nylon or plasticised material) that should weather well in sea water. Each sheet is an identical shape, see FIG. 8. The outline shape is that of the plan shape of the buoy, (wider at one end than the other and rounded). The size of each sheet is the same as, or slightly larger than, the buoy floor (this simply avoids problems in packing). The centre of each sheet is cut out in the same shape as the outside edge. This is to house the central telescopic leg 112,121 and also the smaller diameter canister holder 111.

The sheets of cloth are strongly stitched together in the following way. If six sheets are used, they are divided into three pairs. Each of the pairs are stitched together along radial lines 126. The top and bottom sheets of each pair are stitched together along the short lines 127. Cloth straps are stitched to the top and bottom sheets in the same place 127. These straps are attached to the anchor ring 128 at the top and the ballasted casing at the bottom. When the cloth anchor is folded the pieces lie flat, one on top of the other. When it is opened, or extended, the stitching pattern causes a pocketed concertina that offers considerable resistance to movement when immersed in water.

The water pockets 221 are made of watertight material. They are securely attached to the inflatable section 109 and hang all round the buoy. There is an inner 129 and an outer 130 skirt and a cloth floor that takes the plan shape of the inflated buoy. At intervals around the pockets are stitched weighted bars 131 in a radial fashion. These help to open the pockets after the buoy has inflated and righted itself in the water. Also in a radial fashion are stitched several inside walls between the inner and outer skirt. Several pockets are therefore formed which prevent water flowing freely around the 'sack'.

Water enters the pockets through holes reinforced with rigid rings 132 situated at the top of each pocket. The bottom of the pockets are held in shape by a weighted ring 128 which takes the shape of, and is just larger than the buoy floor. The ring is fastened to the inner skirt.

At the wider end of the buoy (the feet end) are incorporated steps 119 to help a person climb into the buoy. The upper two steps are incorporated in the outer skirt of the water pockets, the third (and subsequent steps if required) is suspended from a rope at either side and attached to the ends of the second step. All the steps have some weight and do not float, so that they maintain their position. The water pocket behind the steps is narrower because the outer skirt is nearer to the inner one to allow enough space for a person to easily locate them and also to provide a space for his feet when climbing in.

THIRD EMBODIMENT

The embodiment of FIGS. 11 and 12 is similar to that of FIGS. 6 to 10 except that instead of a telescopic leg this embodiment uses hinged arms 133. Each arm is hinged at the ends. The top arm and the bottom arm are half the length of the middle arms so that when they fold up against and alongside each other they stretch from one side of the rigid buoy floor 110 to the other without overhanging. The top and bottom arms are attached to the middle of the buoy floor 110 and the ballasted casing 100 respectively, though these can be repositioned to coincide with the centre of balance if this is not in the middle. The hinges incorporate a ratchet device that prevents the arm from folding back on itself as it extends downwards. When fully extended the arms become vertical, and with the ratchet system, form a rigid leg between the floating buoy and the submerged ballast. The number of arms employed depends upon how deep you wish the sea anchor to go.

The gas canister casing 111 is repositioned horizontally under the buoy floor 110 and alongside and parallel to the hinged arms. This allows the floor to be packed closer to the bottom of the ballasted casing 100.

The cloth sea anchor is made of the same type of fabric as described for the telescopic leg method earlier, but the shape of the centre hole needs to be modified to give a clear passage to the hinged arms that require a slot rather than a hole. The cloth sea anchor takes the same outer shape as previously described and is of the same outer dimensions. Again there are several sheets cut to the same shape. A slot 134 is cut out of the sheets up the centre lengthways, the slot being wide enough to house the folded legs. At each end of the slot are attached straps 135 which hold the two halves together. The sheets are stitched together in exactly the same way as previously described, except there are short stitches 127 to be made on the inside. These are to join the same pieces of cloth as do the outer ones 127.

The number of sheets used to make the sea anchor depends upon how deep the whole unit is required to go and how many arms are used to make up the rigid length. There will be an optimum size for the sea anchor in relation to the size of the inflated buoy.

Both the second and third embodiments have a sling-/survival bag, having two purposes. Firstly it is to wrap around the man in the buoy to protect him from the weather, and secondly to form a hammock like sling with one large lifting eye at its apex, so that when the unit is lifted it forms a secure bag so that a man in it cannot fall out.

To achieve this there are two parts to the 'bag'.

The first part forms the lifting sling, see FIG. 6. It is made of strong nylon fabric and is reinforced at its outer edges and in the middle with strong webbing that converge upon the strong rigid lifting eye at the apex. When lifted the sling forms a hammock shape that is lower in the middle and higher at the ends. The ends lift a man's legs and head higher than his torso, which remains in the 'hollow' of the sling. In this position it is not possible for him to fall out. At the bottom of the sling are Velcro strips 114 that allow it be firmly secured to the buoy, the bottom of the sling following the contours of the inside of the buoy. The sides of the sling are laid lengthways along the sides of the buoy with the lifting eye at the head end. This is held in place by Velcro strips.

The man enters the buoy from the water at the feet end, collapses into the buoy and rolls over to assume a half sitting, half lying position within the contours of the buoy, the walls of the inflatable giving support to the back and legs. The lifting eye is at this stage in a prominent position behind the man's head. When it is lifted the Velcro strips along the edges give way and the sling assumes the hammock shape. As the unit is lifted higher the whole unit comes detached from the buoy, as shown in FIG. 6. The man is now lifted aboard safely and easily, leaving the weighted buoy in the water. After use the bag is simply put back in position using the Velcro strips. It is then folded with the deflated buoy ready for use once more.

The second part of the bag deals with the protective covering that shelters the man from the elements. In effect it is a wrap-around bag of suitable material, and forms the inner part of a bag within a bag. The base of the inner bag is sewn into the outer sling and therefore its base follows the same contours as the outer sling. The inner bag is long enough to cover a large man and incorporates in the head end an elasticated hood. The sides are loosely held open for a man to climb in by Velcro tape. The man, once in the buoy, wraps the sides around himself. Again Velcro tape is used to keep the bag 'shut'.

Location devices 136 are situated on top of a short mast 117 which is firmly held in a vertical position (when the buoy is inflated) by a rubber type holder on the outer side of the inflatable section at the head end. The actual siting of the mast is not critical, but must not be fouled by a man climbing into the craft.

The first location aid is a flashing strobe light which will benefit both the vessel and the man in the water, especially at night. The second device is an audible sound emitter that could help a vessel in fog and also a man in the water who loses sight of the buoy periodically due to choppy seas. The third aid is a radio bleep transmitter that can be tracked using the boat's radio direction finding equipment. These aids are brand items bought on the market and incorporated in the mast. However, they can be modified to be powered from one common battery pack also incorporated in the mast and all activated by one on/off switch. The on/off switch can be activated by gravity as the mast assumes its vertical position, or a small rip-cord method can be used.

After the man has been brought aboard using the detachable sling the buoy is brought aboard in a similar fashion. Another large lifting eye lying in the bottom of the buoy floor is exposed by the removal of the sling. Each of three ropes attached to this passes through one of three holes positioned at three equidistant points around the edges of the buoy floor. They each enter the top of the water pockets via the inner water inlet holes, and proceed down to the ring 128 used to hold the water pockets relative to each other. Each rope is attached to this ring. The ropes are taken down the inside of the water pockets to avoid fouling the keel mechanism. When the buoy lifting ring is raised using the same extended boom or derrick used to lift the man aboard, the ring 128 is lifted and this has the effect of reducing the size of the water pockets whilst in the water and expelling water from them out of the same holes it previously entered.

Once the ring engages with the buoy floor the lifting effort now acts on the buoy itself. It is raised out of the water and laid on the deck. Because the water pockets have been emptied of a lot of their water the whole unit is lighter than it would have been.

After use the keel section is folded first into the ballasted casing. The survival bag is repositioned before the buoy is deflated. The buoy is now deflated using the release valves. Using a 'repacking kit' the batteries and gas canister are replaced and the release valves are resealed. The launching bracket is brought back to its vertical position and the inner casing removed. The buoy is packed into both casings, the rip-cord attached and the whole unit re-positioned on the launching bracket ready for use once more.

I claim:

1. Man overboard retrieval apparatus comprising:

an inflatable life buoy (1,101) with a configuration having an upper part (4,5,6,7,8,10; 109,110) which is downwardly concave—when floating in a use position—and is of a size to at least partially accommodate the torso of a man; and a sling (30; 115) for lifting the man arranged at the upper part of the life buoy, the sling (30; 115) having one or more man supporting members (40,41,42) and a lifting eye (31) to which the supporting member(s) (40,41,42) is/are secured, said sling being completely detachable from said life buoy for lifting the man from said life raft;

the eye (31) being so carried by the life buoy (1; 101) as to be easily detached therefrom for lifting of the man with the supporting member(s) extending down from the eye to liftingly support the man whereby, in a rescue operation, said sling separates from said life buoy so the man is lifted in said sling to the rescue craft while said life buoy remains in the water.

2. Man overboard retrieval apparatus as claimed in claim 1, wherein the sling (30; 115) is detachably secured by hook and loop fastening means (38; 114).

3. Man overboard retrieval apparatus as claimed in claim 1 wherein the supporting member(s) (40,41,42) is/are arranged to extend laterally across the upper part of the life buoy (1; 101).

4. Man overboard retrieval apparatus according to claim 3, wherein said life buoy is provided with a ballasted keel;

said keel being of flexible sheet material, depending as an invert cone from said life buoy and being open to surrounding water at its tip only, said invert cone keel filling with water to the virtual exclusion of air.

5. Man overboard retrieval apparatus as claimed in claim 4, where the keel (11) has water ingress apertures (12), at a lower end for filling of it with water and non-return valves at said water ingress apertures for preventing egress of water.

6. Man overboard retrieval apparatus as claimed in claim 5, wherein the keel (11) has breather holes (13) at its tip for emptying it of water.

7. Man overboard retrieval apparatus as claimed in 4, wherein the invert cone keel (11) has rigid stiffening rings (28,29) arranged to extend around a central axis of said cone.

8. Man overboard retrieval apparatus as claimed in claim 1, wherein a plurality of supporting members (40,41,42) are provided interconnected by textile material panels (43,44).

9. Man overboard retrieval apparatus as claimed in claim 1, including a sea anchor (25; 221,125) attached to the life buoy to hang in the surrounding water below it in use.

10. Man overboard retrieval apparatus as claimed in claim 9, wherein the sea anchor is a skirt (25) of textile mesh.

11. Man overboard retrieval apparatus as claimed in claim 9, wherein the sea anchor is a sleeve comprised of a plurality (221,125) of water pockets.

12. Man overboard retrieval apparatus as claimed in claim 1, including steps (18; 119) suspended, in their use position from the life buoy for assisting the man in boarding the life buoy.

13. Man overboard retrieval apparatus as claimed in claim 12, further including a water-pocket (22) suspended in its use position from the life buoy (1) on the opposite side from the steps, the water pocket being arranged to lift water in it above the ambient water level on a man's weight being placed on the steps to counter-balance his weight.

14. Man overboard retrieval apparatus according to claim 1, wherein said life buoy comprises an inflatable tubular ring of irregular pentagon shape with a floor;

said tubular ring having bow sections and a transom section, said bow sections being of a larger cross-section than said transom secction for semi-upright support of the man with his back resting against said bow sections and his legs over said transom section.

15. Man overboard retrieval apparatus comprising:

an inflatable life buoy (1,101) with a configuration having an upper part (4,5,6,7,8,10; 109,110) which is downwardly concave—when floating in a use position—and is of a size to at least partially accommodate the torso of a man; and a sling (30; 115) for lifting the man arranged at the upper part of the life.buoy, the sling (30; 115) having three man supporting members (40,41,42) arranged to extend laterally across the upper part of the life buoy (1; 101), the supporting members are provided one (40) positioned to be drawn up across the man's back at this shoulder blades, the second (41) at his back side and the third (43) behind his knees, and a lifting eye (31) to which the supporting members (40,41,42) are secured, the sling (30; 115) is detachable from the life buoy (1; 101), the eye (31) being so carried by the life buoy (1; 101) as to be easily detached therefrom for lifting of the man with the supporting members extending down from the eye to liftingly support the man.

16. Man overboard retrieval apparatus comprising:

an inflatable life buoy (1,101) with a configuration having an upper part (4,5,6,7,8,10; 109,110) which is downwardly concave—when floating in a use position—and is of a size to at least partially accommodate the torso of a man, the life buoy (1; 101) is provided with a ballasted keel (11,14; 112,121,100; 133,100), the keel is extensible in a rigid form (112,121; 100) and the life buoy has a rigid floor (110); and a sling (30; 115) for lifting the man arranged at the upper part of the life buoy, the sling (30; 115) having one or more man supporting members (40,41,42) arranged to extend laterally across the upper part of the life buoy (1; 101), and a lifting eye (31) to which the supporting member(s) (40,41,42) is/are secured, the sling (30; 115) is detachable from the life buoy (1; 101), the eye (31) being so carried by the life buoy (1; 101) as to be easily detached therefrom for lifting of the man with the supporting member(s) extending down from the eye to liftingly support the man.

17. Man overboard retrieval apparatus comprising:

an inflatable life buoy (1,101) with a configuration having an upper part (4,5,6,7,8,10; 109,110) which is downwardly concave—when floating in a use position—and is of a size to at least partially accommodate the torso of a man, the life buoy (1; 101) is provided with a ballasted keel (11,14; 112,121,100; 133,100) of flexible sheet material and depending as an invert cone (11) from the life buoy, the invert cone keel (11) has rigid stiffening rings (28,29) arranged to extend around a central axis of said cone; and a sling (30; 115) for lifting the man arranged at the upper part of the life buoy, the sling (30; 115) having one or more man supporting members (40,41,42) arranged to extend laterally across the upper part of the life buoy (1; 101) and a lifting eye (31) to which the supporting member(s) (40,41,42) is/are secured, the sling (30; 115) is detachable form the life buoy (1; 101);

the eye (31) being so carried by the life buoy (1; 101) as to be easily detached therefrom for lifting of the man with the supporting member(s) extending down from the eye to liftingly support the man.

18. Man overboard retrieval apparatus comprising:

an inflatable life buoy (1,101) with a configuration having an upper part (4,5,6,7,8,10; 109,110) which is downwardly concave—when floating in a use position—and is of a size to at least partially accommodate the torso of a man;

a sling (30; 115) for lifting the man arranged at the upper part of the life buoy, the sling (30; 115) having one or more man supporting members (40,41,42) and a lifting eye (31) to which the supporting member(s) (40,41,42) is/are secured, the eye (31) being so carried by the life buoy (1; 101) as to be easily detached therefrom for lifting of the man with the supporting member(s) extending down from the eye to liftingly support the man; and a ballasted keel, steps suspended, in their use position from said life buoy, for assisting a man in boarding said buoy and means (20) for bracing the steps (18) against the keel (11).

* * * * *